US012024682B2

(12) United States Patent
Schmidt

(10) Patent No.: US 12,024,682 B2
(45) Date of Patent: Jul. 2, 2024

(54) RECOVERING GASEOUS HYDROCARBONS FROM TANK HEADSPACE

(71) Applicant: Energy and Environmental Research Center Foundation, Grand Forks, ND (US)

(72) Inventor: Darren Schmidt, Williston, ND (US)

(73) Assignee: Energy and Environmental Research Center Foundation, Grand Forks, ND (US)

( * ) Notice: Subject to any disclaimer, the term of this patent is extended or adjusted under 35 U.S.C. 154(b) by 0 days.

(21) Appl. No.: 18/322,930

(22) Filed: May 24, 2023

(65) Prior Publication Data

US 2024/0010924 A1 Jan. 11, 2024

Related U.S. Application Data

(63) Continuation of application No. 18/047,378, filed on Oct. 18, 2022, now Pat. No. 11,697,773, which is a continuation of application No. 17/811,016, filed on Jul. 6, 2022, now Pat. No. 11,505,750.

(51) Int. Cl.
*C10G 5/06* (2006.01)
*C10G 31/06* (2006.01)

(52) U.S. Cl.
CPC ..... *C10G 5/06* (2013.01); *C10G 2300/4012* (2013.01); *C10G 2400/28* (2013.01)

(58) Field of Classification Search
CPC ..... C10G 5/06; C10G 31/06
See application file for complete search history.

(56) References Cited

U.S. PATENT DOCUMENTS 7,833,317 B2 11/2010 Lund
9,758,735 B2 9/2017 Meyer
9,988,581 B2 6/2018 Meyer
10,017,701 B2 7/2018 Meyer
11,505,750 B1 11/2022 Schmidt
11,697,773 B1 7/2023 Schmidt
11,814,591 B1 11/2023 Schmidt
2008/0223796 A1* 9/2008 Silva Valente ..... C10G 33/00 210/512.3
2024/0010925 A1 1/2024 Schmidt

FOREIGN PATENT DOCUMENTS

WO 2021262624 12/2021

OTHER PUBLICATIONS

"Crude Oil Stabilization and Recovery", Aspen Engineering Services, LLC, [Online] Retrieved from the Internet: URL: https: aspenesco.com uploads 3 4 8 5 34851592 cosr_brochure _--_ aspen.pdf, (2018), 1 pg.
"U.S. Appl. No. 17/811,016, Notice of Allowance mailed Sep. 7, 2022".
"U.S. Appl. No. 18/047,378, Notice of Allowance mailed Mar. 29, 2023", 9 pgs.
"U.S. Appl. No. 18/171,019, Notice of Allowability mailed Oct. 19, 2023", 2 pgs.
"U.S. Appl. No. 18/171,019, Notice of Allowance mailed Jun. 14, 2023", 9 pgs.

* cited by examiner

*Primary Examiner* — Randy Boyer
(74) *Attorney, Agent, or Firm* — Schwegman Lundberg & Woessner, P.A.

(57) ABSTRACT

A method of recovering gaseous hydrocarbons from tank headspace includes flowing a hydrocarbon gas composition from headspace of a tank fed by a secondary separator into a compressor to form a compressed mixture. The method includes flowing the compressed mixture into a cooling unit to cool the compressed mixture, to form a cooled composition including liquid hydrocarbons. The method includes recovering the liquid hydrocarbons as a recovered liquid hydrocarbon stream.

18 Claims, 2 Drawing Sheets

RECOVERING GASEOUS HYDROCARBONS FROM TANK HEADSPACE

PRIORITY APPLICATION

This application is a continuation of, and claims priority to U.S. patent application Ser. No. 18/047,378, field on Oct. 18, 2022, which is a continuation of, and claims priority to U.S. patent application Ser. No. 17/811,016, filed on Jul. 6, 2022, the disclosures of which are incorporated by reference herein in their entirety.

BACKGROUND

Hydrocarbon gases are almost always associated with crude oil in an oil reserve because they represent the lighter chemical fraction (shorter molecular chain) formed when organic remains are converted into hydrocarbons. Such hydrocarbon gases may exist separately from the crude oil in the underground formation or they may be dissolved in the crude oil. As the crude oil is extracted from the reservoir and raised to the surface, or subsequent to that process, the pressure in the crude oil is reduced and dissolved hydrocarbon gases come out of solution. Such gases occurring in combination with the crude oil are often referred to as "associated" gas.

At well pads where the production of oil and associated gas is of high volume and high pressure, so called high producing well pads, it is economical to use existing technologies to separate the associated gas from the oil to produce what may be called "sales" gas and to process the sales gas. The processing of the sales gas can produce pipeline-quality natural gas as well as purity products in the form of propane, butane, and gas condensate. The natural gas is introduced into a gas pipeline or a storage means for onward transmission and/or sale, and the purity products are generally sold and or stored separately. The sales gas generally includes around 50% methane ($CH_3$), 20% ethane ($C_2H_6$), 13% propane ($C_3H_8$), 5% butane ($C_4H_{10}$), and the balance is heaver hydrocarbons.

At well pads where the production of oil and associated gas is not of high volume or high pressure (so called low-producing well pads), it may not be economic to install and use existing technologies to process the sales gas in the same way that it is processed at high producing well pads. At such well pads, any gas that comes out of the oil may be treated as "flare" or "vent" gas.

Once the crude oil has been extracted from the ground, it is generally passed through a primary separator such as a two-phase separator with the intention of separating the sales gas from the oil. Thereafter the oil may undergo other processes, for example passing that oil through a secondary separator such as a heater treater apparatus and/or storage in a storage tank. Associated gases are given off by the oil during those other processes. Those gases are at low pressure and generally contain little to no methane, and the majority of the gas is a mixture of ethane, propane and butane. This gas may be called "rich gas" because it is rich in ethane, propane and butane (e.g., having less than 50 mole % methane). These gases are also often known as "flare" or "vent" gases. It is conventionally not economical to process this rich gas in the same fashion as the sales gas is processed.

Rich gas has historically been considered to be a by-product or waste product of oil production and this gas has been typically disposed of by venting or flaring (burning). Venting and flaring are relatively inexpensive ways to deal with rich gas, but result in relatively high emissions (e.g., large quantities of greenhouse gases) and fail to capture any of the energy or value contained within the gas. Improved flaring systems and methods have been developed to reduce flare emissions sufficiently to satisfy stringent emission standards; however, many of these improved flaring systems merely convert the energy within the flare gas into thermal energy which releases to the environment. These improved flaring systems do not capture the energy contained within the flare gas, let alone recover the full value of the gas. Any flaring system will, in addition to its criteria pollutants, contribute to carbon dioxide emissions (carbon footprint) generated by the operator of the flare. There is ever-increasing pressure on oil field operators to reduce and minimize their carbon footprint.

Other gas utilization techniques such as bi-fueling diesel engines or frac water heating have been tried, but those techniques have been found to be challenged with marginal economics and rely on niche applications and/or a large volume throughput.

SUMMARY OF THE INVENTION

Various aspects of the present invention relate to hydrocarbon gas recovery methods and apparatuses, such as for the recovery of hydrocarbon gas that is emitted during the extraction and treatment of crude oil which would otherwise be vented or flared (i.e., lost).

Various aspects of the present invention provide a method of recovering gaseous hydrocarbons from tank headspace. The method includes flowing a hydrocarbon gas composition from headspace of a tank fed by a secondary separator into a compressor to form a compressed mixture. The secondary separator accepts a crude liquid hydrocarbon input stream from a primary separator. The primary separator includes a crude hydrocarbon input stream and includes an output stream including the crude liquid hydrocarbon stream that is inputted to the secondary separator. The method includes flowing the compressed mixture into a cooling unit to cool the compressed mixture, to form a cooled composition including liquid hydrocarbons. The method also includes recovering the liquid hydrocarbons as a recovered liquid hydrocarbon stream.

Various aspects of the present invention provide a method of recovering gaseous hydrocarbons from tank headspace. The method includes flowing a hydrocarbon gas composition from headspace of a tank fed by a separator into a compressor to form a compressed mixture, wherein the separator accepts a crude hydrocarbon input stream and outputs a crude liquid hydrocarbon stream to the tank. The method includes flowing the compressed mixture into a cooling unit to cool the compressed mixture, to form a cooled composition comprising liquid hydrocarbons. The method also includes recovering the liquid hydrocarbons as a recovered liquid hydrocarbon stream.

Various aspects of the present invention provide a method of recovering gaseous hydrocarbons from tank headspace. The method includes flowing a hydrocarbon gas composition from headspace of a tank fed by a heater-treater into a compressor to form a compressed mixture. The heater-treater accepts a crude liquid hydrocarbon input stream from a two-phase separator. The two-phase separator includes a crude hydrocarbon input stream and includes an output stream including the crude liquid hydrocarbon stream that is inputted to the heater-treater. The method includes flowing the compressed mixture into a cooling unit to cool the compressed mixture, to form a cooled composition including liquid hydrocarbons. The method includes recovering the liquid hydrocarbons as a recovered liquid hydrocarbon stream. The method includes flowing the recovered liquid hydrocarbon stream into the two-phase separator.

Various aspects of the present invention provide an apparatus for recovering gaseous hydrocarbons from tank headspace. The apparatus includes a compressor that accepts a hydrocarbon gas composition from headspace of a tank fed by a secondary separator. The secondary separator accepts a crude liquid hydrocarbon input stream from a primary separator. The primary separator includes a crude hydrocarbon input stream and includes an output stream that includes the crude liquid hydrocarbon stream that is inputted to the secondary separator. The apparatus includes a cooling unit that accepts the compressed mixture from the compressor and that forms a cooled composition including liquid hydrocarbons. The apparatus also includes a flowline from the cooling unit for recovering the liquid hydrocarbons as a recovered liquid hydrocarbon stream.

Various aspects of the presently claimed invention provide advantages over other methods and apparatuses for petroleum processing or recovery. For example, various aspects of the present invention allow efficient and cost-effective recovery of gaseous hydrocarbons from tank headspace (e.g., rich gas) that are normally vented or flared, or that conventionally cannot be recovered with such high efficiency. For example, compressors normally require regular oil changes for maintenance, resulting in downtime and increased cost. However, in various aspects of the present invention, by using an oilless compressor that is free of oil that contacts material being compressed and is free of oil lubrication that requires regular changings, the need for oil changes is eliminated, dramatically reducing the cost of hydrocarbon recovery.

In various aspects, the cooling unit of the present invention efficiently cools both large and small volumes of gas. The cooling unit can efficiently operate on a small scale which has the benefit of enabling the method to be deployed at well pads and other places where the rich (flare) gas or mixture of rich (flare) and sales gases are generated in small volumes. The ability of the method and apparatus of the present invention to operate economically in connection with rich gas that is generated at small volume is advantageous. This is because although any one such location is likely to give rise to only a relatively small volume of gas, failure to recover that small volume of gas at a large number of such locations (for example, one or more oil fields which have a large number of well pads that each generate a small volume of flare gas) will lead to a large cumulative volume of non-recovered rich gas. That large volume would, if flared, represent a large contribution to the oil field or operator's carbon footprint and associated emissions. The method and apparatus of the present invention thus provides a method of reducing the volume of flared gas at locations of crude oil production and at oil producing facilities.

In various aspects, the method and apparatus of the present invention can remove oxygen and/or other contaminants (e.g., sulfur, oxygen, and/or water) from the gaseous hydrocarbons from the tank headspace. In various aspects, the method and apparatus of the present invention can remove such contaminants more effectively and/or at higher efficiency than other methods and apparatuses for recovery of rich gas. For example, one particular challenge in the recovery of tank headspace gas is the intake of air or breathing. Breathing within a tank headspace volume can be attributed to ambient temperature changes and/or liquid level changes within the fixed volume of the storage space, with air entering or gases exiting the tank to make up for the resulting pressure change. Normal breathing of storage tanks contaminates the hydrocarbon gas headspace with oxygen from ambient air. Pipeline transmission requirements typically allow for only very low concentrations of oxygen. A unique advantage of various aspects of the present method and apparatus is the separation and decrease/elimination of oxygen from the recovered hydrocarbons.

In various aspects, the method and apparatus of the present invention can generate a lower proportion of methane and a higher proportion of heavier hydrocarbons in the sales products. In various aspects, the method and apparatus of the present invention can capture hydrocarbons that would otherwise be lost (e.g., vented or flared), increasing sales by 0.1 to 5%, 0.5% to 2.5%, or 1% to 2% per well, and/or increasing sales gas volume by 3% to 9%, or 4% to 8%, or 5 to 7% per well, and/or increasing sales liquid volume by 0.1 to 5%, 0.5% to 2.5%, or 1% to 2% per well.

BRIEF DESCRIPTION OF THE FIGURES

The drawings illustrate generally, by way of example, but not by way of limitation, various aspects of the present invention.

DETAILED DESCRIPTION OF THE INVENTION

Figure 1:
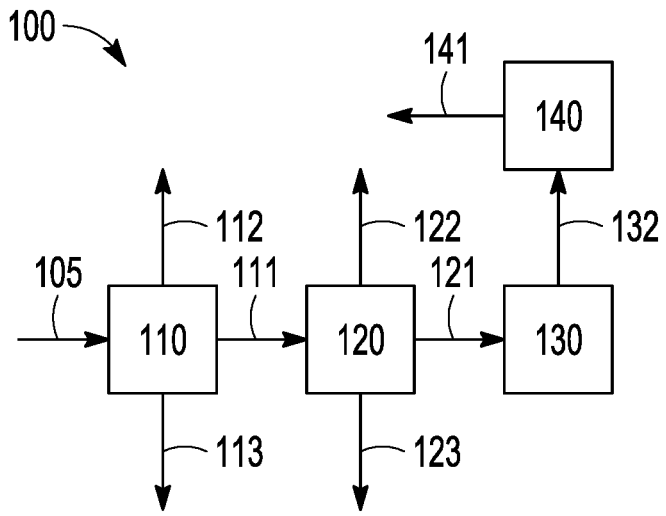
FIG. 1 illustrates a method and apparatus for recovering gaseous hydrocarbons from tank headspace, in accordance with various aspects.

Reference will now be made in detail to certain aspects of the disclosed subject matter. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range. The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that about 0 wt % to about 5 wt % of the composition is the material, or about 0 wt % to about 1 wt %, or about 5 wt % or less, or less than or equal to about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less, or about 0 wt %.

Method of Recovering Gaseous Hydrocarbons from Tank Headspace.

Various aspects of the present invention provide a method of recovering gaseous hydrocarbons from tank headspace. The method can include flowing a hydrocarbon gas composition from headspace of a tank into a compressor to form a compressed mixture. The tank can be fed by a secondary separator. The secondary separator can accept a crude liquid hydrocarbon input stream from a primary separator. The primary separator can include a crude hydrocarbon input stream and can include an output stream including the crude liquid hydrocarbon stream that is inputted to the secondary separator. The method can include flowing the compressed mixture into a cooling unit to cool the compressed mixture, to form a cooled composition including liquid hydrocarbons. The method can also include recovering the liquid hydrocarbons as a recovered liquid hydrocarbon stream.

The crude hydrocarbon input stream can be any suitable hydrocarbon input stream. For example, the crude hydrocarbon input stream can be from an oil well. The oil well can be at an on-shore oil recovery or production facility or an off-shore oil recovery or production facility. The crude hydrocarbon input stream can have any suitable pressure, such as a pressure of 10 psi (70 kPa) to 500 psi (3447 kPa), or 50 psi (345 kPa) to 100 psi (689 kPa).

The primary separator can be any suitable separator that performs separation on the crude hydrocarbon input stream. The primary separator accepts the crude hydrocarbon input stream and outputs a crude hydrocarbon liquid stream and a crude hydrocarbon gaseous stream (e.g., sales and/or flare gas). The primary separator can also optionally output a water stream. The primary separator can include a two-phase separator (e.g., having liquid and gaseous outputs) or a three-phase separator (e.g., having a water output, a liquid hydrocarbon output, and a gaseous output). The primary separator can be heated (e.g., a heater-treater). The primary separator can be unheated (e.g., free-water-knockout (FWKO)). The primary separator can include a separator column. The primary separator can include a level sensor to detect a height of liquid such as water and/or hydrocarbons. The primary separator can be operated at a pressure greater than 50 psi, such as 50-500 psi.

The hydrocarbon gas composition from the headspace of the tank is rich gas that is rich in ethane, propane, and butane, and has less than 50 mole % methane (e.g., 1 to 50 mole % methane). The hydrocarbon gas composition can have any suitable oxygen concentration, such as an oxygen concentration of 0 mole % to 20 mole % oxygen, or 1 mole % to 15 mole %, or 3 mole % to 6 mole %, or less than or equal to 20 mole % and greater than or equal to 0 mole %, 1, 2, 3, 4, 5, 6, 7, 8, 9, 10, 11, 12, 13, 14, 15, 16, 17, 18, or 19 mole % oxygen. In various aspects, the hydrocarbon gas composition is less than 10 mole % methane, up to 90 mole % ethane, propane, butane, and pentane, and up to 10 mole % of hydrocarbons heavier than pentane. The hydrocarbon gas composition from the headspace of the tank can have any suitable pressure, such as 0.01 psi (0.1 kPa) to 2 psi (14 kPa), or 0.1 psi (1 kPa) to 2 psi (14 kPa).

The method can optionally include flowing the hydrocarbon gas composition from the headspace of the tank to a primary recovery separator. The method can include flowing the hydrocarbon gas from the primary recovery separator to the compressor. The primary recovery separator can include a two-phase separator or a three-phase separator. The primary recovery separator can include a heated separator or an unheated separator. The primary recovery separator can include a scrubber. The primary recovery separator can condense liquids from the hydrocarbon gas composition, can remove water from the hydrocarbon gas composition, or a combination thereof. The primary recovery separator can provide a low point to knock-out moisture and other condensate prior to compression. Liquids (e.g., hydrocarbons and water) can drain from the bottom of the primary recovery separator. The primary recovery separator can include a level sensor to detect a height of liquid such as water and/or hydrocarbons. The method can include flowing a gaseous hydrocarbon stream from the primary recovery separator (e.g., sales and/or flare gas). The primary recovery separator can optionally include a hydrocarbon gas output that can include oxygen that is removed from the tank vapors.

The compressor can include any suitable type of compressor. The compressor can include a piston compressor, a scroll compressor, or a combination thereof. The compressor can include an oilless compressor. The oilless compressor can include a crankcase that is free of oil that contacts material being compressed and is free of oil lubrication that requires regular changings. The method can be free of compression via a compressor that includes oil that contacts material being compressed and/or that includes oil lubrication that requires regular changings. The compressed mixture formed by the compressor can have any suitable pressure, such as a pressure of 100 psi (689 kPa) to 500 psi (3447 kPa), or 200 psi (1379 kPa) to 300 psi (2068 kPa). The compressed mixture formed by the compressor can have any suitable temperature, such as a temperature of 100° C. to 300° C., or 125° C. to 175° C.

The cooling unit can be any suitable cooling unit that cools the compressed mixture. The cooling unit can include a heat exchanger, a refrigeration unit, an aftercooler, or a combination thereof. The cooling unit can include an air-cooled heat exchanger, a water-cooled heat exchanger, or a combination thereof. The cooling unit can include an air-cooled heat exchanger. The cooled composition can have any suitable pressure, such as a pressure of 100 psi (689 kPa) to 500 psi (3447 kPa), or 200 psi (1379 kPa) to 300 psi (2068 kPa). The cooled composition can have any suitable temperature that is less than the temperature of the compressed mixture formed by the compressor, such as a temperature of 0° C. to 80° C., or 10° C. to 40° C., or within 10° C. of ambient temperature.

The recovering of the liquid hydrocarbons can optionally include separating the liquid hydrocarbons from any gaseous hydrocarbons and/or water in the cooled composition. The method can include flowing the cooled composition including liquid hydrocarbons to a secondary recovery separator, and recovering the liquid hydrocarbons can include flowing the liquid hydrocarbons from the secondary recovery separator. The secondary recovery separator can be any suitable separator. The secondary recovery separator can include a two-phase separator or a three-phase separator. The secondary recovery separator can include a heated separator or an unheated separator. The secondary recovery separator can include a separator column. The secondary recovery separator can include a level sensor to detect a height of liquid such as water and/or hydrocarbons. The method can include flowing a water stream from the secondary recovery separator. The method can include flowing a gaseous hydrocarbon stream from the secondary recovery separator (e.g., sales or flare gas). Recovering the liquid hydrocarbons can include flowing the liquid hydrocarbons from the secondary recovery separator into the primary separator, flowing the recovered liquid hydrocarbon stream into the secondary separator, combining the recovered liquid hydrocarbons into a hydrocarbon liquid composition output from the secondary separator, or a combination thereof. Recovering the liquid hydrocarbons can include flowing the liquid hydrocarbons from the secondary recovery separator into the primary separator.

Various aspects include a primary recovery separator with no secondary recovery separator. Various aspects include a secondary recovery separator with no primary recovery separator. Various aspects include both a primary recovery separator and a secondary recovery separator.

The secondary separator accepts the crude liquid hydrocarbon stream from the primary separator, and outputs a liquid hydrocarbon stream and a gaseous hydrocarbon stream (e.g., rich gas). The liquid hydrocarbon stream is fed to the tank. The liquid hydrocarbon stream can be fed directly to the tank. The liquid hydrocarbon stream can be fed indirectly to the tank; for example, the liquid hydrocarbon stream can be fed to the primary separator which can perform separation operations on the liquid hydrocarbon stream before feeding it to the tank. The secondary separator can be any suitable separator. For example, the secondary separator can include a two-phase separator or a three-phase phase separator. The secondary separator can include a heated separator or an unheated separator. The secondary separator can include a heater-treater or a vapor recovery tower (VRT). The secondary separator can include a heater-treater. The secondary separator can operate at any suitable pressure, and can feed the tank at any suitable pressure, such as a pressure of 5 psi (34 kPa) to 80 psi (552 kPa), or 20 psi (138 kPa) to 50 psi (344 kPa).

Recovering the liquid hydrocarbons can include flowing the recovered liquid hydrocarbon stream into the primary separator, flowing the recovered liquid hydrocarbon stream into the secondary separator, combining the recovered liquid hydrocarbons into a hydrocarbon liquid composition output from the secondary separator, or a combination thereof.

The recovered liquid hydrocarbon stream can include natural gas liquids. The recovered liquid hydrocarbon stream can include methane, ethane, propane, butane, pentane, hydrocarbons having 6 or more carbon atoms, or a combination thereof. The recovered liquid hydrocarbon stream can include <10% methane, up to 90% ethane, propane, butane, and pentane, and up to 10% hydrocarbons heavier than pentane. The recovered liquid hydrocarbon stream can have less than 10 ppm oxygen, such as greater than or equal to 0, 0.001, 0.01, or 0.1 ppm oxygen and less than or equal to 10 ppm, 9, 8, 7, 6, 5, 4, 3, 2, 1, or 0.5 ppm oxygen Apparatus for Recovering Gaseous Hydrocarbons from Tank Headspace.

Various aspects of the present invention provide an apparatus for performing aspects of the method of the present invention for recovering gaseous hydrocarbons from tank headspace. The apparatus can be any suitable apparatus that can perform the method described herein. For example, the apparatus can include a compressor that accepts a hydrocarbon gas composition from headspace of a tank fed by a secondary separator. The secondary separator can accept a crude liquid hydrocarbon input stream from a primary separator. The primary separator can include a crude hydrocarbon input stream and include an output stream that includes the crude liquid hydrocarbon stream that is inputted to the secondary separator. The apparatus can include a cooling unit that accepts the compressed mixture from the compressor and that forms a cooled composition including liquid hydrocarbons. The apparatus also includes a flowline from the cooling unit for recovering the liquid hydrocarbons as a recovered liquid hydrocarbon stream. The apparatus, including the primary separator, secondary separator, compressor, cooler, optional primary recovery separator, optionally secondary recovery separator, or a combination thereof, can include can one or more suitable features as disclosed herein with respect to the method of the present invention for recovering gaseous hydrocarbons from tank headspace.

The apparatus can optionally further include a primary recovery separator that accepts the hydrocarbon gas composition from headspace of the tank fed by the secondary separator and that flows the hydrocarbon gas composition from the primary recovery separator to the compressor.

The apparatus can optionally further include a secondary recovery separator that accepts the cooled composition including the liquid hydrocarbons and the outputs the recovered liquid hydrocarbon stream.

The flowline from the cooling unit can flow the recovered liquid hydrocarbon stream to any suitable location. For example, the flowline from the cooling unit can flow the recovered liquid hydrocarbon stream into the primary separator, into the secondary separator, into a hydrocarbon liquid composition output from the secondary separator (e.g., to sales), or a combination thereof.

FIG. 1 illustrates a method and apparatus for recovering gaseous hydrocarbons from tank headspace, in accordance with various aspects. Apparatus 100 includes crude hydrocarbon input stream 105 which is fed to primary separator 110. The primary separator 110 outputs crude liquid hydrocarbon stream 111. The primary separator 110 optionally outputs hydrocarbon gas stream 112 (first stage gas). The primary separator 110 optionally outputs water stream 113. The crude liquid hydrocarbon stream 111 is fed to secondary separator 120. The secondary separator 120 outputs liquid hydrocarbon stream 121. The secondary separator 120 optionally outputs hydrocarbon gas stream 122 (second stage gas). The secondary separator 120 optionally outputs water stream 123. Water streams 113 and 123 can be combined and sent to a tank for storage and or treatment. Liquid hydrocarbon stream 121 is fed to tank 130. A hydrocarbon gas composition (headspace gas) 132 is flowed from the headspace of tank 130 into an apparatus 140 for recovering gaseous hydrocarbons from tank headspace according to the present invention. Apparatus 140 outputs recovered liquid hydrocarbon stream 141. Various aspects of apparatus 140 are illustrated in detail in FIGS. 3 and 4.

Figure 2A:
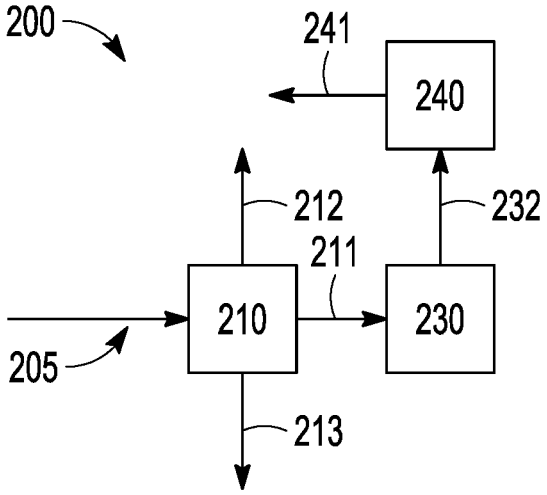
FIG. 2A illustrates a method and apparatus for recovering gaseous hydrocarbons from tank headspace, in accordance with various aspects.

FIG. 2A illustrates a method and apparatus for recovering gaseous hydrocarbons from tank headspace, in accordance with various aspects. Apparatus 200 includes crude hydrocarbon input stream 205 which is fed to primary separator 210. In other aspects, separator 210 can be a secondary separator. The primary separator 210 outputs crude liquid hydrocarbon stream 211. The primary separator 210 outputs hydrocarbon gas stream 212 (first stage gas). The primary separator 210 optionally outputs water stream 213. Crude liquid hydrocarbon stream 211 is fed to tank 230. A hydrocarbon gas composition (headspace gas) 232 is flowed from the headspace of tank 230 into an apparatus 240 for recovering gaseous hydrocarbons from tank headspace according to the present invention. Apparatus 240 outputs recovered liquid hydrocarbon stream 241 (e.g., back to separator 210, not shown). Various aspects of apparatus 240 are illustrated in detail in FIGS. 3 and 4.

Figure 2B:
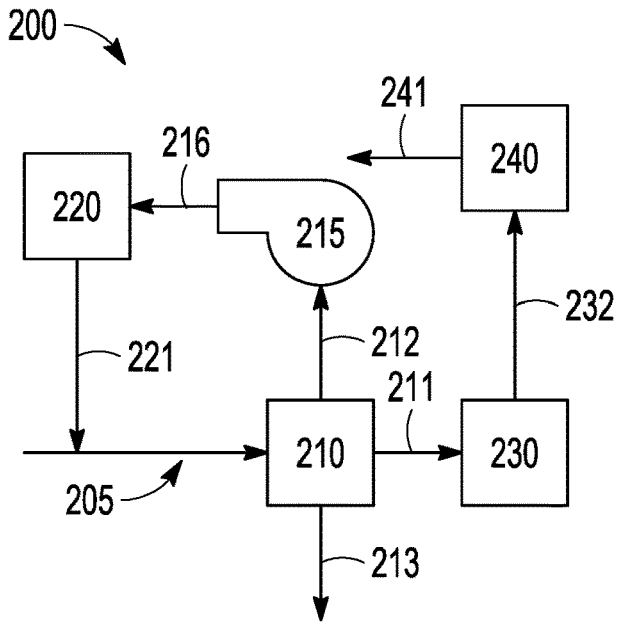
FIG. 2B illustrates a method and apparatus for recovering gaseous hydrocarbons from tank headspace, in accordance with various aspects.

FIG. 2B illustrates an embodiment of the apparatus 200 shown in FIG. 2A including additional features. FIG. 2B illustrates a method and apparatus for recovering gaseous hydrocarbons from tank headspace, in accordance with various aspects. Apparatus 200 includes crude hydrocarbon input stream 205 which is fed to primary separator 210. In other aspects, separator 210 can be a secondary separator. The primary separator 210 outputs crude liquid hydrocarbon stream 211. The primary separator 210 outputs hydrocarbon gas stream 212 (first stage gas). The primary separator 210 optionally outputs water stream 213. The primary separator outputs hydrocarbon gas stream 210. The hydrocarbon gas stream 212 is fed to compressor 215, which generates a compressed gas stream 216. Compressed gas stream 216 is fed to secondary separator 220 which outputs liquid hydrocarbon stream 221. Secondary separator 220 can also optionally output hydrocarbon gas and water streams (not shown). Liquid hydrocarbon stream 221 is combined with crude hydrocarbon input stream 205. The primary separator outputs liquid hydrocarbon stream 221 which is fed to tank 230. The liquid hydrocarbon stream 221 is thereby fed to the tank 230 by first passing through (and having separatory operations performed thereon in) primary separator 210. A hydrocarbon gas composition (headspace gas) 232 is flowed from the headspace of tank 230 into an apparatus 240 for recovering gaseous hydrocarbons from tank headspace according to the present invention. Apparatus 240 outputs recovered liquid hydrocarbon stream 241. Various aspects of apparatus 240 are illustrated in detail in FIGS. 3 and 4.

Figure 3:
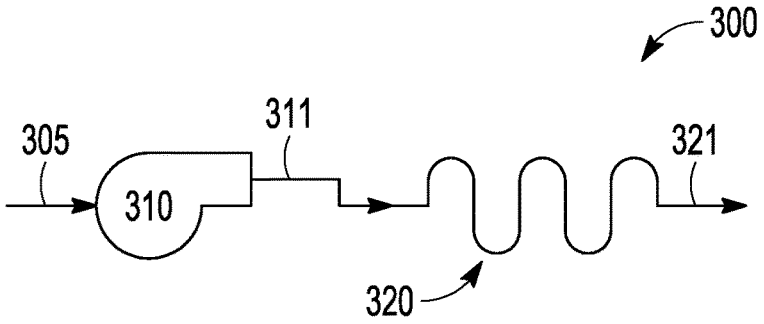
FIG. 3 illustrates a method and apparatus for recovering gaseous hydrocarbons, in accordance with various aspects.

FIG. 3 illustrates a method and apparatus for recovering gaseous hydrocarbons, in accordance with various aspects. Apparatus 300 includes compressor 310, which is fed by the hydrocarbon gas composition (headspace gas) 305. The compressor outputs compressed mixture 311, which is fed to cooling unit 320. Cooling unit 320 forms a cooled composition including liquid hydrocarbons 321.

Figure 4:
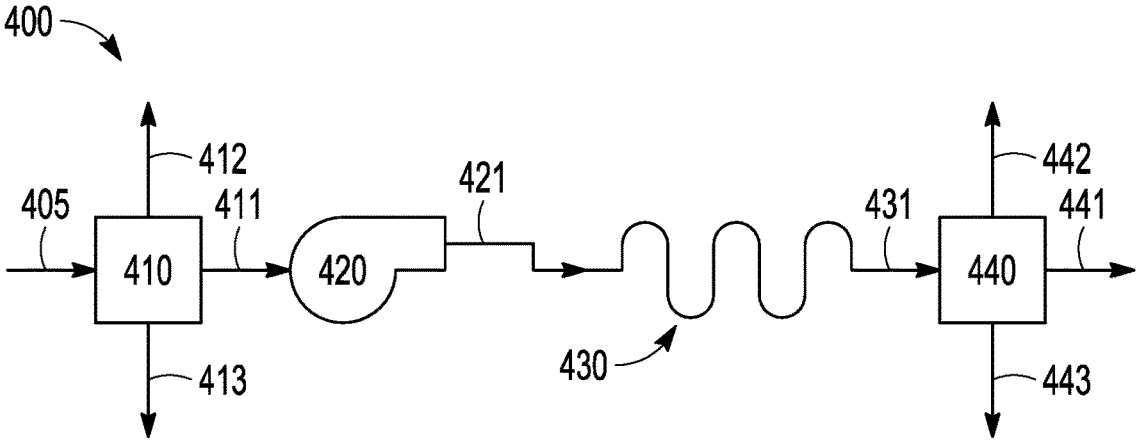
FIG. 4 illustrates a method and apparatus for recovering gaseous hydrocarbons, in accordance with various aspects.

FIG. 4 illustrates a method and apparatus for recovering gaseous hydrocarbons, in accordance with various aspects. Apparatus 400 includes a primary recovery separator 410, which is fed by the hydrocarbon gas composition (headspace gas) 405. Primary recovery separator outputs hydrocarbon gas composition 411. Primary recovery separator can optionally output water stream 413 and hydrocarbon gas stream 412. Hydrocarbon gas composition 411 is fed to compressor 420, which forms compressed mixture 421. The compressed mixture is fed to cooling unit 430, which forms cooled composition 431 including liquid hydrocarbons. The cooled composition including liquid hydrocarbons 431 is fed to secondary recovery separator 440. Secondary recovery separator 440 forms a liquid composition including the liquid hydrocarbons 441. Secondary recovery separator 440 optionally forms hydrocarbon gas stream 442 and water stream 443.

The terms and expressions that have been employed are used as terms of description and not of limitation, and there is no intention in the use of such terms and expressions of excluding any equivalents of the features shown and described or portions thereof, but it is recognized that various modifications are possible within the scope of the aspects of the present invention. Thus, it should be understood that although the present invention has been specifically disclosed by specific aspects and optional features, modification and variation of the concepts herein disclosed may be resorted to by those of ordinary skill in the art, and that such modifications and variations are considered to be within the scope of aspects of the present invention.

Exemplary Aspects.

The following exemplary aspects are provided, the numbering of which is not to be construed as designating levels of importance:

Aspect 1 provides a method of recovering gaseous hydrocarbons from tank headspace, the method comprising:

flowing a hydrocarbon gas composition from headspace of a tank fed by a secondary separator into a compressor to form a compressed mixture, wherein the secondary separator accepts a crude liquid hydrocarbon input stream from a primary separator, wherein the primary separator comprises a crude hydrocarbon input stream and comprises an output stream comprising the crude liquid hydrocarbon stream that is inputted to the secondary separator;

flowing the compressed mixture into a cooling unit to cool the compressed mixture, to form a cooled composition comprising liquid hydrocarbons; and recovering the liquid hydrocarbons as a recovered liquid hydrocarbon stream.

Aspect 2 provides the method of Aspect 1, wherein the crude hydrocarbon input stream is from an oil well at an on-shore oil recovery or production facility.

Aspect 3 provides the method of Aspect 1, wherein the crude hydrocarbon input stream is from an oil well at an off-shore oil recovery or production facility.

Aspect 4 provides the method of any one of Aspects 1-3, wherein the crude hydrocarbon input stream has a pressure of 10 psi (70 kPa) to 500 psi (3447 kPa).

Aspect 5 provides the method of any one of Aspects 1-4, wherein the crude hydrocarbon input stream has a pressure of 50 psi (345 kPa) to 100 psi (689 kPa).

Aspect 6 provides the method of any one of Aspects 1-5, wherein the primary separator comprises a two-phase separator or a three-phase separator.

Aspect 7 provides the method of any one of Aspects 1-6, wherein the primary separator comprises a heated separator.

Aspect 8 provides the method of any one of Aspects 1-6, wherein the primary separator comprises an unheated separator.

Aspect 9 provides the method of any one of Aspects 1-8, wherein the primary separator comprises a two-phase separator.

Aspect 10 provides the method of any one of Aspects 1-9, wherein the primary separator comprises the crude liquid hydrocarbon output stream and a crude hydrocarbon gaseous output stream.

Aspect 11 provides the method of any one of Aspects 1-10, wherein the hydrocarbon gas composition from the headspace of the tank comprises methane, ethane, propane, butane, hydrocarbons having 5 or more carbon atoms, or a combination thereof.

Aspect 12 provides the method of any one of Aspects 1-11, wherein the hydrocarbon gas composition from the headspace of the tank is less than 50 mole % methane and is predominantly ethane, propane, and butane.

Aspect 13 provides the method of any one of Aspects 1-12, wherein the hydrocarbon gas composition from the headspace of the tank has a pressure of 0.01 psi (0.1 kPa) to 2 psi (14 kPa).

Aspect 14 provides the method of any one of Aspects 1-13, wherein the hydrocarbon gas composition from the headspace of the tank has a pressure of 0.1 psi (1 kPa) to 2 psi (14 kPa).

Aspect 15 provides the method of any one of Aspects 1-14, further comprising flowing the hydrocarbon gas composition from the headspace of the tank to a primary recovery separator, and flowing the hydrocarbon gas composition from the primary recovery separator to the compressor.

Aspect 16 provides the method of Aspect 15, wherein the primary recovery separator comprises a two-phase separator or a three-phase separator.

Aspect 17 provides the method of any one of Aspects 15-16, wherein the primary recovery separator comprises a heated separator.

Aspect 18 provides the method of any one of Aspects 15-16, wherein the primary recovery separator comprises an unheated separator.

Aspect 19 provides the method of any one of Aspects 15-18, wherein the primary recovery separator comprises a scrubber.

Aspect 20 provides the method of any one of Aspects 15-19, wherein the primary recovery separator condenses liquids from the hydrocarbon gas composition, removes water from the hydrocarbon gas composition, or a combination thereof.

Aspect 21 provides the method of any one of Aspects 1-20, wherein the compressor comprises a piston compressor, a scroll compressor, or a combination thereof.

Aspect 22 provides the method of any one of Aspects 1-21, wherein the compressor comprises an oilless compressor, wherein the oilless compressor comprises a crankcase that is free of oil that contacts material being compressed and is free of oil lubrication that requires regular changings.

Aspect 23 provides the method of any one of Aspects 1-22, wherein the method is free of compression via a compressor that comprises oil that contacts material being compressed and/or that comprises oil lubrication that requires regular changings.

Aspect 24 provides the method of any one of Aspects 1-23, wherein the compressed mixture has a pressure of 100 psi (689 kPa) to 500 psi (3447 kPa).

Aspect 25 provides the method of any one of Aspects 1-24, wherein the compressed mixture has a pressure of 200 psi (1379 kPa) to 300 psi (2068 kPa).

Aspect 26 provides the method of any one of Aspects 1-25, wherein the compressed mixture has a temperature of 100° C. to 300° C.

Aspect 27 provides the method of any one of Aspects 1-26, wherein the compressed mixture has a temperature of 125° C. to 175° C.

Aspect 28 provides the method of any one of Aspects 1-27, wherein the cooling unit comprises a heat exchanger, a refrigeration unit, an aftercooler, or a combination thereof.

Aspect 29 provides the method of any one of Aspects 1-28, wherein the cooling unit comprises an air-cooled heat exchanger, a water-cooled heat exchanger, or a combination thereof.

Aspect 30 provides the method of any one of Aspects 1-29, wherein the cooling unit comprises an air-cooled heat exchanger.

Aspect 31 provides the method of any one of Aspects 1-30, wherein the cooled composition has a pressure of 100 psi (689 kPa) to 500 psi (3447 kPa).

Aspect 32 provides the method of any one of Aspects 1-31, wherein the cooled composition has a pressure of 200 psi (1379 kPa) to 300 psi (2068 kPa).

Aspect 33 provides the method of any one of Aspects 1-32, wherein the cooled composition has a temperature of 0° C. to 80° C.

Aspect 34 provides the method of any one of Aspects 1-33, wherein the cooled composition has a temperature of 10° C. to 40° C.

Aspect 35 provides the method of any one of Aspects 1-34, wherein recovering the liquid hydrocarbons comprises separating the liquid hydrocarbons from any gaseous hydrocarbons and/or water in the cooled composition.

Aspect 36 provides the method of any one of Aspects 1-35, further comprising flowing the cooled composition comprising liquid hydrocarbons to a secondary recovery separator, wherein recovering the liquid hydrocarbons comprises flowing the liquid hydrocarbons from the secondary recovery separator.

Aspect 37 provides the method of Aspect 36, wherein the secondary recovery separator comprises a two-phase separator or a three-phase separator.

Aspect 38 provides the method of any one of Aspects 36-37, wherein the secondary recovery separator comprises a heated separator.

Aspect 39 provides the method of any one of Aspects 36-37, wherein the secondary recovery separator comprises an unheated separator.

Aspect 40 provides the method of any one of Aspects 36-39, wherein the secondary recovery separator comprises a separator column.

Aspect 41 provides the method of any one of Aspects 36-40, wherein the secondary recovery separator comprises a level sensor.

Aspect 42 provides the method of any one of Aspects 36-41, wherein the method further comprises flowing a water stream from the secondary recovery separator.

Aspect 43 provides the method of any one of Aspects 36-42, wherein the method further comprises flowing a gaseous hydrocarbon stream from the secondary recovery separator.

Aspect 44 provides the method of any one of Aspects 36-43, wherein recovering the liquid hydrocarbons comprises flowing the liquid hydrocarbons from the secondary recovery separator into the primary separator.

Aspect 45 provides the method of any one of Aspects 1-44, wherein the secondary separator comprises a two-phase separator or a three-phase separator.

Aspect 46 provides the method of any one of Aspects 1-45, wherein the secondary separator comprises a heated separator.

Aspect 47 provides the method of any one of Aspects 1-45, wherein the secondary separator comprises an unheated separator.

Aspect 48 provides the method of any one of Aspects 1-47, wherein the secondary separator comprises a heater-treater or a vapor recovery tower (VRT).

Aspect 49 provides the method of any one of Aspects 1-48, wherein the secondary separator comprises a heater-treater.

Aspect 50 provides the method of any one of Aspects 1-49, wherein the secondary separator feeds the tank at a pressure of 5 psi (34 kPa) to 80 psi (552 kPa).

Aspect 51 provides the method of any one of Aspects 1-50, wherein the secondary separator feeds the tank at a pressure of 20 psi (138 kPa) to 50 psi (344 kPa).

Aspect 52 provides the method of any one of Aspects 1-51, wherein recovering the liquid hydrocarbons comprising flowing the cooled composition into the primary separator.

Aspect 53 provides the method of any one of Aspects 1-52, wherein recovering the liquid hydrocarbons comprises flowing the recovered liquid hydrocarbon stream into the primary separator.

Aspect 54 provides the method of any one of Aspects 1-53, wherein recovering the liquid hydrocarbons comprises flowing the recovered liquid hydrocarbon stream into the secondary separator.

Aspect 55 provides the method of any one of Aspects 1-54, wherein recovering the liquid hydrocarbons comprises combining the recovered liquid hydrocarbons into a hydrocarbon liquid composition output from the secondary separator.

Aspect 56 provides the method of any one of Aspects 1-55, wherein the recovered liquid hydrocarbon stream comprises natural gas liquids.

Aspect 57 provides the method of any one of Aspects 1-56, wherein the recovered liquid hydrocarbon stream comprises methane, ethane, propane, butane, pentane, hydrocarbons having 6 or more carbon atoms, or a combination thereof.

Aspect 58 provides the method of any one of Aspects 1-57, wherein the recovered liquid hydrocarbon stream comprises <10% methane, up to 90% ethane, propane, butane, and pentane, and up to 10% hydrocarbons heavier than pentane.

Aspect 59 provides the method of any one of Aspects 1-58, wherein the recovered liquid hydrocarbon stream is less than 10 ppm oxygen.

Aspect 60 provides a method of recovering gaseous hydrocarbons from tank headspace, the method comprising:

flowing a hydrocarbon gas composition from headspace of a tank fed by a heater-treater into a compressor to form a compressed mixture, wherein the heater-treater accepts a crude liquid hydrocarbon input stream from a two-phase separator, wherein the two-phase separator comprises a crude hydrocarbon input stream and comprises an output stream comprising the crude liquid hydrocarbon stream that is inputted to the heater-treater;

flowing the compressed mixture into a cooling unit to cool the compressed mixture, to form a cooled composition comprising liquid hydrocarbons;

recovering the liquid hydrocarbons as a recovered liquid hydrocarbon stream; and flowing the recovered liquid hydrocarbon stream into the two-phase separator; or the method comprising:

flowing a hydrocarbon gas composition from headspace of a tank fed by a separator (e.g., a primary separator or a secondary separator) into a compressor to form a compressed mixture, wherein the separator accepts a crude hydrocarbon input stream and outputs a crude liquid hydrocarbon stream to the tank;

flowing the compressed mixture into a cooling unit to cool the compressed mixture, to form a cooled composition comprising liquid hydrocarbons; and recovering the liquid hydrocarbons as a recovered liquid hydrocarbon stream (such as including flowing the recovered liquid hydrocarbon stream to the separator).

Aspect 61 provides an apparatus for performing the method of any one of Aspects 1-60.

Aspect 62 provides an apparatus for recovering gaseous hydrocarbons from tank headspace, the apparatus comprising:

a compressor that accepts a hydrocarbon gas composition from headspace of a tank fed by a secondary separator, wherein the secondary separator accepts a crude liquid hydrocarbon input stream from a primary separator, wherein the primary separator comprises a crude hydrocarbon input stream and comprises an output stream that comprises the crude liquid hydrocarbon stream that is inputted to the secondary separator;

a cooling unit that accepts the compressed mixture from the compressor and that forms a cooled composition comprising liquid hydrocarbons; and a flowline from the cooling unit for recovering the liquid hydrocarbons as a recovered liquid hydrocarbon stream.

Aspect 63 provides the apparatus of Aspect 62, further comprising a primary recovery separator that accepts the hydrocarbon gas composition from headspace of the tank fed by the secondary separator and that flows the hydrocarbon gas composition from the primary recovery separator to the compressor.

Aspect 64 provides the apparatus of any one of Aspects 62-63, further comprising a secondary recovery separator that accepts the cooled composition comprising the liquid hydrocarbons and that outputs the recovered liquid hydrocarbon stream.

Aspect 65 provides the apparatus of any one of Aspects 62-64, wherein the flowline from the cooling unit flows the recovered liquid hydrocarbon stream into the primary separator.

Aspect 66 provides the apparatus of any one of Aspects 62-65, wherein the flowline from the cooling unit flows the recovered liquid hydrocarbon stream into the secondary separator.

Aspect 67 provides the apparatus of any one of Aspects 62-66, wherein the flowline from the cooling unit flows the recovered liquid hydrocarbon stream into a hydrocarbon liquid composition output from the secondary separator.

Aspect 68 provides the method or apparatus of any one or any combination of Aspects 1-67 optionally configured such that all elements or options recited are available to use or select from.

What is claimed is:

1. A method of recovering gaseous hydrocarbons from tank headspace, the method comprising:

flowing a hydrocarbon gas composition from headspace of a tank fed by a primary separator into a compressor to form a compressed mixture, wherein the primary separator accepts a crude hydrocarbon input stream and outputs a crude liquid hydrocarbon stream to the tank, wherein the compressor comprises an oilless compressor, and wherein the oilless compressor comprises a crankcase that is free of oil that contacts material being compressed and is free of oil lubrication that requires regular changings;

flowing the compressed mixture into a cooling unit to cool the compressed mixture, to form a cooled composition comprising liquid hydrocarbons; and recovering the liquid hydrocarbons as a recovered liquid hydrocarbon stream.

2. The method of claim 1, wherein the primary separator comprises a two-phase separator.

3. The method of claim 1, wherein the primary separator outputs a hydrocarbon gas stream to a secondary compressor that generates a compressed gas stream.

4. The method of claim 3, wherein the secondary compressor comprises an oilless compressor, wherein the oilless compressor comprises a crankcase that is free of oil that contacts material being compressed and is free of oil lubrication that requires regular changings.

5. The method of claim 3, comprising feeding the compressed gas stream to a secondary separator that outputs a liquid hydrocarbon stream.

6. The method of claim 5, wherein the secondary separator comprises a heater-treater.

7. The method of claim 5, comprising feeding the liquid hydrocarbon stream to the primary separator.

8. The method of claim 5, comprising combining the liquid hydrocarbon stream with the crude hydrocarbon input stream.

9. The method of claim 1, wherein the flowline from the cooling unit flows the recovered liquid hydrocarbon stream into the primary separator.

10. The method of claim 1, wherein the flowline from the cooling unit flows the recovered liquid hydrocarbon stream into a hydrocarbon liquid composition output from the primary separator.

11. The method of claim 1, wherein the flowline from the cooling unit flows the recovered liquid hydrocarbon stream into another separator.

12. The method of claim 1, further comprising a primary recovery separator that accepts the hydrocarbon gas composition from headspace of the tank fed by the separator and that flows the hydrocarbon gas composition from the primary recovery separator to the compressor.

13. The method of claim 12, wherein the primary recovery separator comprises a scrubber.

14. The method of claim 1, further comprising a secondary recovery separator that accepts the cooled composition comprising the liquid hydrocarbons and that outputs the recovered liquid hydrocarbon stream.

15. The method of claim 14, wherein the secondary recovery separator comprises a separator column.

16. The method of claim 1, wherein the crude hydrocarbon input stream is from an oil well at an on-shore oil recovery or production facility.

17. The method of claim 1, wherein the cooling unit comprises an air-cooled heat exchanger.

18. A method of recovering gaseous hydrocarbons from tank headspace, the method comprising:

flowing a hydrocarbon gas composition from headspace of a tank fed by a primary separator into a compressor to form a compressed mixture, wherein the primary separator accepts a crude hydrocarbon input stream, outputs a crude liquid hydrocarbon stream to the tank, and outputs a hydrocarbon gas stream to a secondary compressor that generates a compressed gas stream;

flowing the compressed gas stream to a secondary separator that outputs a liquid hydrocarbon stream;

flowing the liquid hydrocarbon stream to the primary separator;

flowing the compressed mixture into a cooling unit to cool the compressed mixture, to form a cooled composition comprising liquid hydrocarbons; and recovering the liquid hydrocarbons as a recovered liquid hydrocarbon stream.

* * * * *